US011697973B2

(12) United States Patent
Garcia et al.

(10) Patent No.: US 11,697,973 B2
(45) Date of Patent: Jul. 11, 2023

(54) MODULAR DOWNHOLE PACKER

(71) Applicant: TAM INTERNATIONAL, INC., Houston, TX (US)

(72) Inventors: Luis Garcia, Kingwood, TX (US); Caleb Kelley, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 45 days.

(21) Appl. No.: 17/576,608

(22) Filed: Jan. 14, 2022

(65) Prior Publication Data

US 2022/0228453 A1 Jul. 21, 2022

Related U.S. Application Data

(60) Provisional application No. 63/138,476, filed on Jan. 17, 2021.

(51) Int. Cl.

| | |
|---|---|
| ***E21B 33/06*** | (2006.01) |
| ***E21B 23/06*** | (2006.01) |
| ***E21B 33/12*** | (2006.01) |
| ***E21B 23/01*** | (2006.01) |

(52) U.S. Cl.
CPC ..... *E21B 23/06* (2013.01); *E21B 23/01* (2013.01); *E21B 33/12* (2013.01)

(58) Field of Classification Search
CPC ..... E21B 23/06; E21B 23/01; E21B 33/12; E21B 33/127; E21B 34/10; E21B 33/1272; E21B 33/128; E21B 33/1285
See application file for complete search history.

(56) References Cited

U.S. PATENT DOCUMENTS 2,786,535 A * 3/1957 Boer ..... E21B 34/10 166/321
3,437,142 A * 4/1969 Conover ..... E21B 33/127 166/290
4,191,383 A * 3/1980 Baker ..... E21B 33/1277 277/312
4,253,676 A * 3/1981 Baker ..... E21B 33/1277 166/387

(Continued)

OTHER PUBLICATIONS

Search and Examination Report issued in Application No. GB 2200516.9 dated Jun. 17, 2022; 5 pages.

*Primary Examiner* — Steven A Macdonald
(74) *Attorney, Agent, or Firm* — Ewing & Jones, PLLC

(57) ABSTRACT

A modular downhole packer includes a valve body, which includes a threaded coupler adapted to couple to a tubular and a valve assembly. The packer includes a packer element assembly, which includes a first end coupler, the first end coupler mechanically coupled to the valve body; a packer element; and a second end coupler. The packer includes a floating seal element mechanically coupled to the second end coupler, the floating seal element including a seal extension. The packer includes a floating end anchor. The floating end anchor includes a compression seal housing, the compression seal housing including an outer sealing surface positioned within the seal extension of the second end coupler; a compression seal positioned within a seal pocket formed in the compression seal housing; and an anchor body, the anchor body threadedly coupled to the seal pocket of the compression seal housing, the anchor body abutting the compression seal.

15 Claims, 5 Drawing Sheets

(56) References Cited

U.S. PATENT DOCUMENTS

| | | | | |
|---|---|---|---|---|
| 4,424,861 | A * | 1/1984 | Carter, Jr. | F16J 15/46 166/212 |
| 4,458,752 | A | 7/1984 | Brandell | |
| 4,614,346 | A * | 9/1986 | Ito | E21B 33/1277 166/187 |
| 4,798,243 | A | 1/1989 | Curington et al. | |
| 5,143,015 | A * | 9/1992 | Lubitz | E21B 33/127 166/182 |
| 5,540,280 | A | 7/1996 | Schultz et al. | |
| 6,915,858 | B2 * | 7/2005 | Dolyniuk | E21B 33/12 166/182 |

* cited by examiner

MODULAR DOWNHOLE PACKER

CROSS REFERENCE TO RELATED APPLICATIONS

This application is a non-provisional application which claims priority from U.S. provisional application No. 63/138,476, filed Jan. 17, 2021, which is hereby incorporated by reference in its entirety.

TECHNICAL FIELD/FIELD OF THE DISCLOSURE

The present disclosure relates generally to wellbore isolation devices, and specifically to elements for inflatable packers.

BACKGROUND OF THE DISCLOSURE

Fluid-energized, or inflatable, packers are isolation devices used in a downhole wellbore to seal against the inside of the wellbore or a downhole tubular to separate the section of wellbore or tubular on one side of the inflatable packer from that on the other side of the inflatable packer. Typical inflatable packers use elastic bladders positioned on the outside of a precision mandrel which, in response to an increased pressure within the bladder, expand until they contact the surrounding wellbore or tubular. Continued expansion causes an increase in contact area and force between the bladder and the wellbore or tubular, thereby sealing the annular space around the packer.

SUMMARY

The present disclosure provides for a modular downhole packer. The modular downhole packer may include a valve body, the valve body including a threaded coupler adapted to couple to a tubular and a valve assembly. The modular downhole packer may include a packer element assembly. The packer element assembly may include a first end coupler, the first end coupler mechanically coupled to the valve body; a packer element; and a second end coupler. The modular downhole packer may include a floating seal element, the floating seal element mechanically coupled to the second end coupler, the floating seal element including a seal extension. The modular downhole packer may include a floating end anchor. The floating end anchor may include a compression seal housing, the compression seal housing including an outer sealing surface positioned within the seal extension of the second end coupler; a compression seal positioned within a seal pocket formed in the compression seal housing; and an anchor body, the anchor body threadedly coupled to the seal pocket of the compression seal housing, the anchor body abutting the compression seal.

The present disclosure also provides for a method. The method may include providing a tubular, the tubular having a threaded end. The method may include mechanically coupling a valve housing to the threaded end of the tubular. The method may include mechanically coupling a packer element assembly to the valve housing. The packer element assembly may be positioned about the tubular. The method may include mechanically coupling a floating seal element to the packer element assembly; mechanically coupling a floating end anchor to the floating seal element, the floating end anchor including a compression seal; compressing the compression seal to the tubular; and anchoring the floating end anchor to the tubular.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
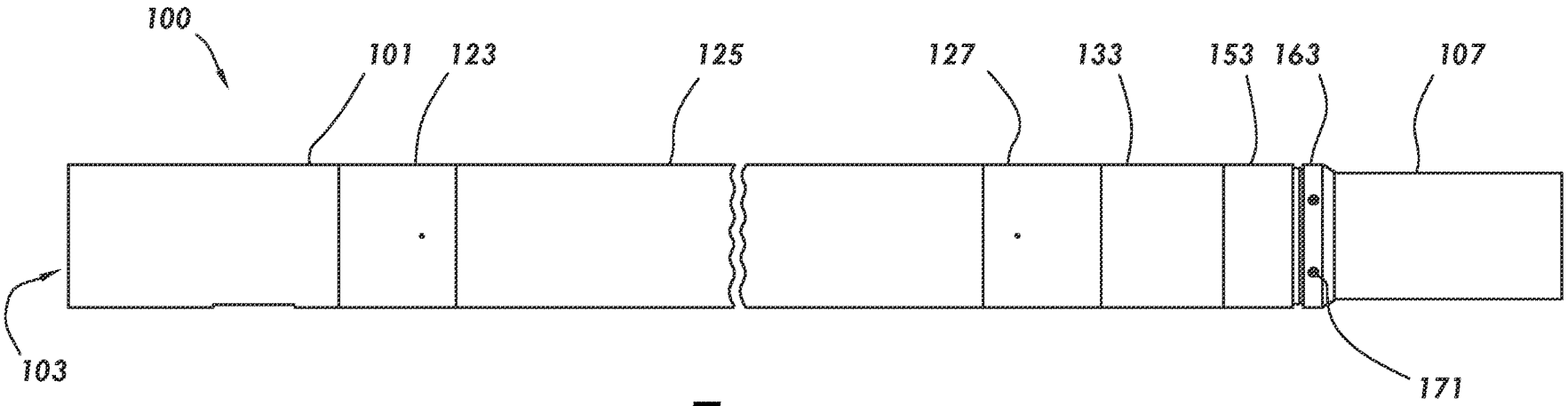
FIG. 1 depicts a side elevation view of a modular downhole packer positioned on a tubular member consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
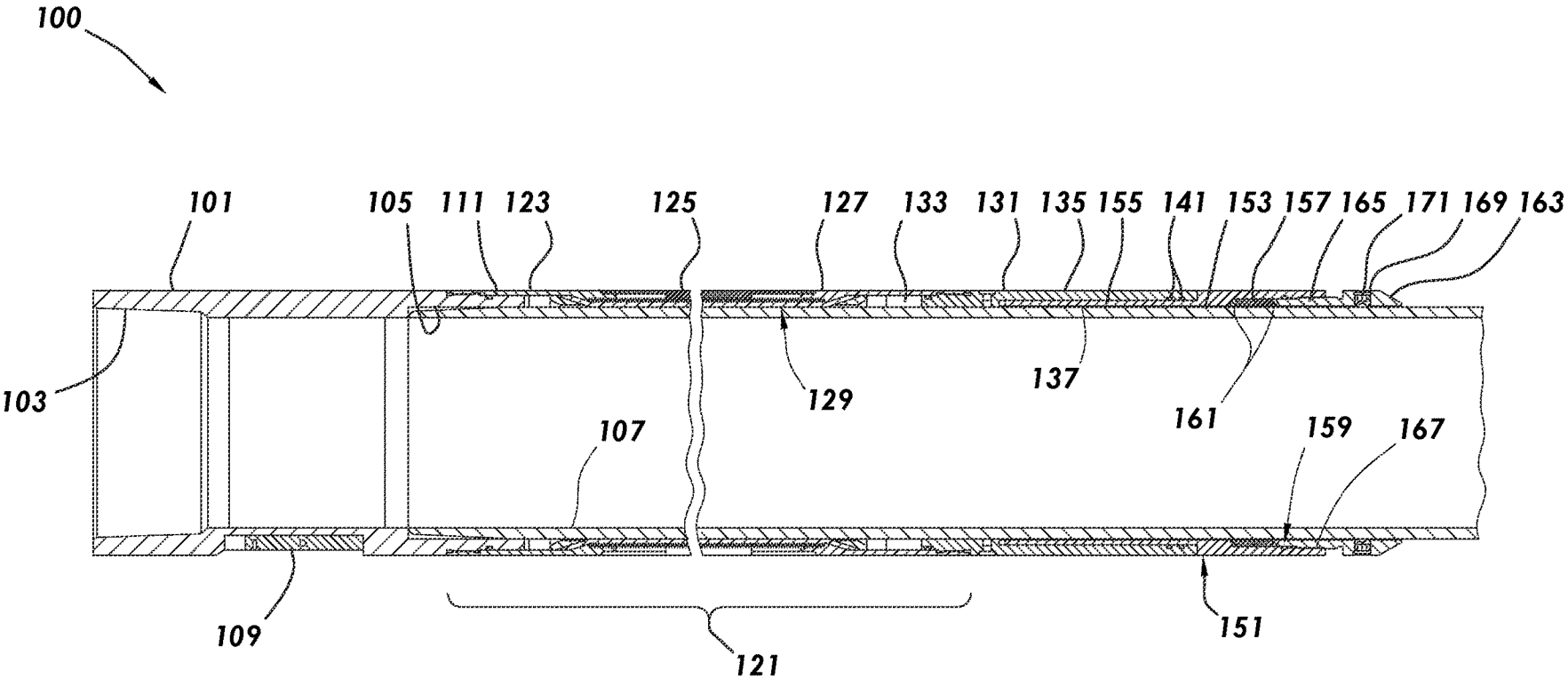
FIG. 2 depicts a cross section view of the modular downhole packer of FIG. 1.

FIGS. 1, 2 depict modular downhole packer system 100. Modular downhole packer system 100 may include valve body 101. Valve body 101 may, in some embodiments, be generally tubular and may include first threaded coupler 103 and second threaded coupler 105. First and second threaded couplers 103, 105 may be positioned to allow valve body 101 to be threadedly coupled to a tubular string such as a casing string for use in a wellbore. In some embodiments, first threaded coupler 103 may be used to couple to tubular members of the casing string above or below modular downhole packer system 100 and second threaded coupler 105 may couple to tubular 107, which may be used as a mandrel of modular downhole packer system 100 as further described below. Tubular 107 may be a piece of casing or other tubular used within a wellbore. Unlike a traditional mandrel for an inflatable packer, tubular 107 does not need a precision-finished outer surface and may be provided from, for example and without limitation, normal, unmodified casing or drill pipe used during a casing operation of a wellbore as found on a wellsite. Thus, specialized mandrels are not required to use modular downhole packer system 100 and thus do not need to be manufactured, stocked, or shipped to the wellsite. Additionally, tubular 107 may be mechanically coupled to valve body 101 by threading tubular 107 to second threaded coupler 105 of valve body 101 using an existing threaded end of tubular 107, rather than relying on a welded connection between mandrel and valve body as would be required in a traditional inflatable packer.

In some embodiments, valve body 101 may include valve assembly 109 positioned to allow for the actuation of modular downhole packer system 100 using fluid pressure from within valve body 101 as provided through the tubular string within which modular downhole packer system 100 is included as further described below.

In some embodiments, modular downhole packer system 100 may include packer element assembly 121. Packer element assembly 121 may be tubular in shape and may be positioned about and extend along tubular 107. In some embodiments, packer element assembly 121 may include first end coupler 123, packer element 125, and second end coupler 127. First end coupler 123 and second end coupler 127 may be mechanically coupled to packer element 125 such that packer element 125 is positioned about tubular 107. The annular space between packer element 125 and tubular 107 may be defined as interior cavity 129 of modular downhole packer system 100 and may be sealed to tubular 107 as further described below such that when fluid pressure within interior cavity 129 increases, packer element 125 inflates and moves radially outward from tubular 107.

Figure 3:
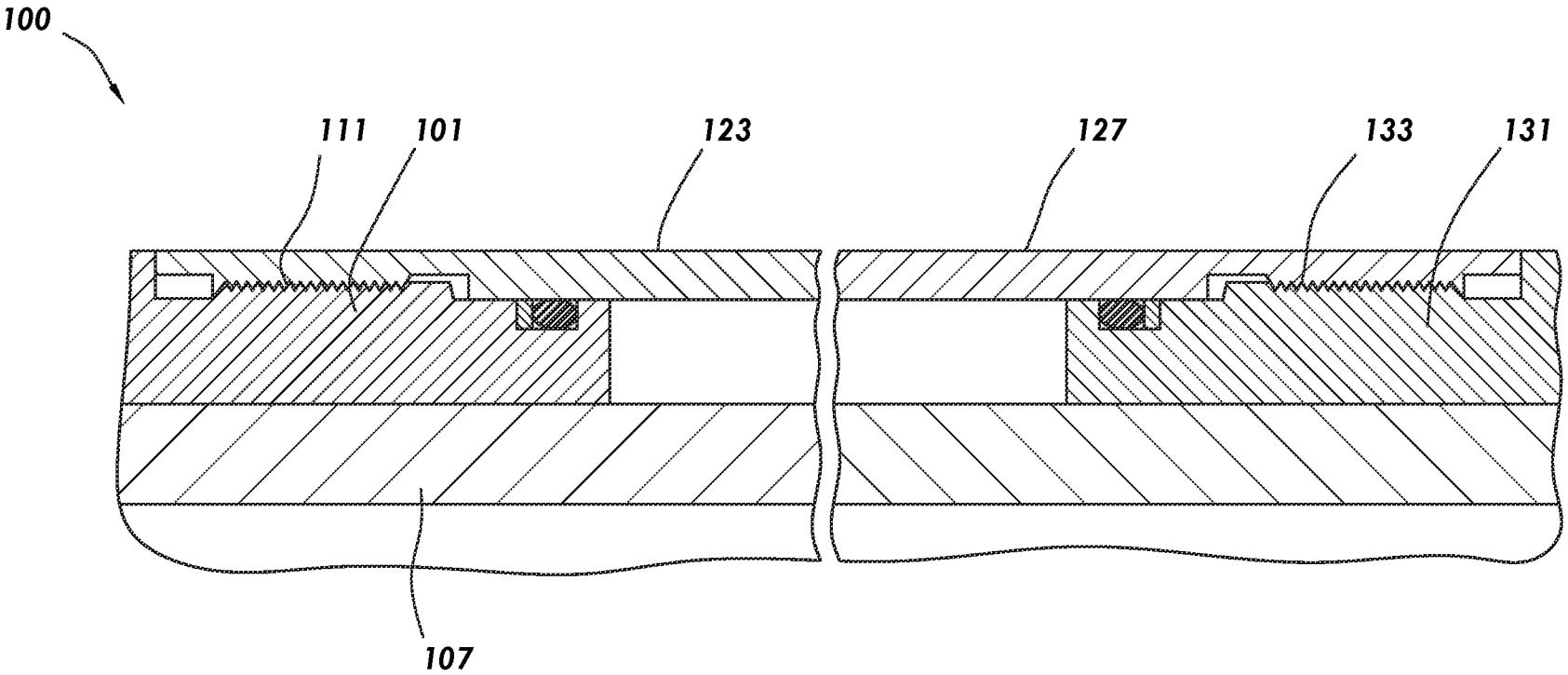
FIG. 3 depicts a partial cross section view of modular downhole packer consistent with at least one embodiment of the present disclosure.

In some embodiments, first end coupler 123 may, as shown in FIG. 3, threadedly couple to valve body 101 at element coupler 111 of valve body 101. In other embodiments, first end coupler 123 may be mechanically coupled to valve body 101 using one or more of set screws, snap rings, or a press fit. In some embodiments, element coupler 111 may be formed on the outer diameter of valve body 101 while second threaded coupler 105 is formed on the inner diameter of valve body 101 within element coupler 111. In some embodiments, valve body 101 may fluidly seal against both tubular 107 and first end coupler 123, thereby defining one end of interior cavity 129. In some embodiments, valve assembly 109 may be fluidly coupled to interior cavity 129 to allow for inflation of packer element 125.

In some embodiments, second end coupler 127 may be threadedly coupled to floating seal element 131 at element coupler 133. In other embodiments, second end coupler 127 may be mechanically coupled to floating seal element 131 by, for example and without limitation, one or more of set screws, snap rings, or a press fit. As shown in FIG. 2, floating seal element 131 may be generally tubular and may be positioned about tubular 107. In some embodiments, floating seal element 131 may include seal extension 135. Seal extension 135 may be formed at the end of floating seal element 131 opposite element coupler 133. Seal extension 135 may include inner sealing surface 137.

In some embodiments, modular downhole packer system 100 may include floating end anchor 151. Floating end anchor 151 may mechanically couple to tubular 107 and may, as discussed below, provide for a surface against which seal extension 135 of second end coupler 127 may fluidly seal, thus defining the other end of interior cavity 129 of packer element assembly 121.

Figure 4:
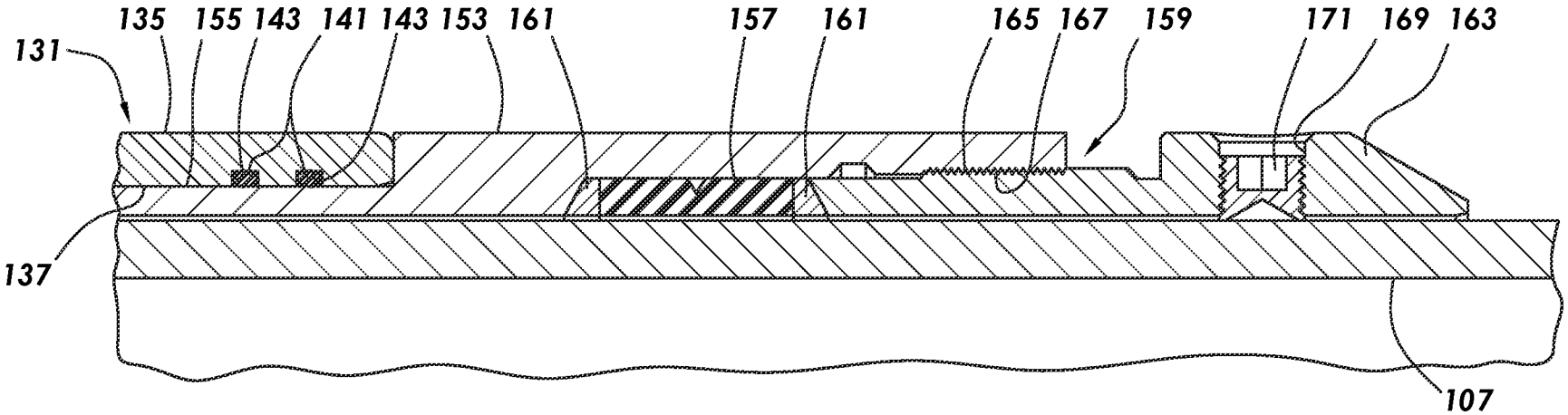
FIG. 4 depicts a partial cross section view of a modular downhole packer consistent with at least one embodiment of the present disclosure.

In some embodiments, as shown in FIG. 4, floating end anchor 151 may include compression seal housing 153. Compression seal housing 153 may be positioned about tubular 107. Compression seal housing 153 may include outer sealing surface 155. Outer sealing surface 155 may be generally cylindrical and may extend along tubular 107 in the direction of valve body 101. In some embodiments, outer sealing surface 155 may receive seal extension 135 of floating seal element 131. Compression seal housing 153 may be mechanically fixed to tubular 107 while floating seal element 131 is able to move relative to tubular 107 and compression seal housing 153 during actuation of modular downhole packer system 100 as further described below.

In some embodiments, one or more seals 141 may be positioned between inner sealing surface 137 and outer sealing surface 155. For example and without limitation, as shown in FIG. 4, seals 141 may be positioned in seal grooves 143 formed in inner sealing surface 137. In other embodiments, seals 141 may be positioned in seal grooves formed in outer sealing surface 155 or may be positioned in both inner sealing surface 137 and outer sealing surface 155. In some embodiments, one or both of inner sealing surface 137 and outer sealing surface 155 may be formed at a sufficient tolerance such that seals 141 maintain a fluid seal against the respective surface throughout the full range of motion of floating seal element 131 during actuation of modular downhole packer system 100. Unlike a typical inflatable packer, for example and without being bound to theory, the surface quality and dimensional accuracy of tubular 107 does not affect the ability of modular downhole packer system 100 to maintain a fluid seal during actuation thereof. Tubular 107 may therefore be formed from an ordinary tubular element rather than a precision-formed mandrel as in a typical inflatable packer.

In some embodiments, floating end anchor 151 may include compression seal 157. Compression seal 157 may be positioned about tubular 107 within seal pocket 159 formed in compression seal housing 153. In some embodiments, floating end anchor 151 may further include compression seal backup rings 161 positioned about tubular 107 abutting each end of compression seal 157. Seal backup rings 161 may, in some embodiments, engage compression seal 157 and may, without being bound to theory, reduce extrusion of compression seal 157 during actuation of compression seal 157 as further described below.

In some embodiments, floating end anchor 151 may include anchor body 163. Anchor body 163 may be tubular or annular and may be positioned about tubular 107. In some embodiments, anchor body 163 may include external compression threads 165 positioned to engage with inner compression threads 167 formed in seal pocket of compression seal housing 153. Anchor body 163 may thereby be threadedly coupled to compression seal housing 153.

Figure 5:
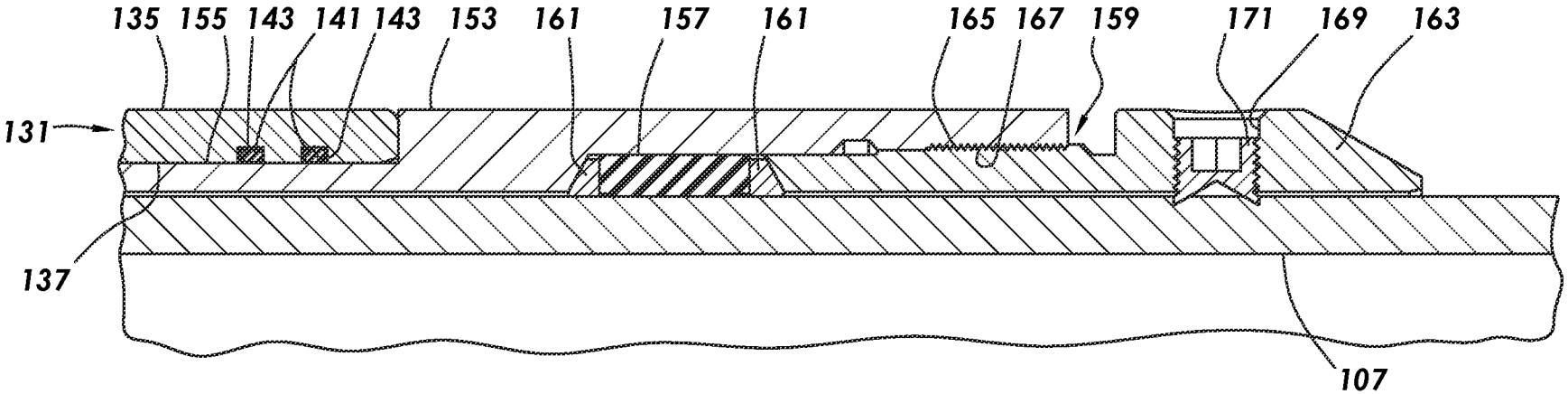
FIG. 5 depicts a partial cross section view of the modular downhole packer of FIG. 4 in an anchored position.

In some embodiments, as anchor body 163 is threadedly tightened to compression seal housing 153, anchor body 163 may engage compression seal 157 (via, in some embodiments, seal backup rings 161) and may longitudinally compress compression seal 157 as shown in FIG. 5. Such compression may, in some embodiments, cause compression seal 157 to deform into contact with tubular 107 and compression seal housing 153 such that compression seal 157 creates a fluid seal therebetween. In some embodiments, as compression seal 157 is deformed against the outer surface of tubular 107, compression seal 157 may conform to the outer profile of tubular 107, thereby compensating for any surface defects or tolerance offsets in the outer surface of tubular 107 caused by the use of ordinary, non-precision tubular members. Compression seal 157 may therefore provide a seal against tubular 107 for the other sealed end of interior cavity 129.

In some embodiments, anchor body 163 may include one or more threaded holes 169 formed radially through anchor body 163 adapted to receive set screws 171. Once compression seal 157 is sufficiently compressed due to threaded engagement between anchor body 163 and compression seal housing 153, set screws 171 may be further threadedly engaged to anchor body 163 until set screws 171 engage against tubular 107, Such engagement may, for example and without limitation, retain anchor body 163 and compression seal housing 153 in position relative to tubular 107 and may reduce or prevent relative rotation between anchor body 163 and compression seal housing 153, thereby maintaining the engagement of compression seal 157 and tubular 107.

In some embodiments, components of modular downhole packer system 100 may be supplied to a wellsite in a disassembled condition excluding tubular 107, which may be sourced from casing already found at the wellsite. In order to assemble modular downhole packer system 100, valve body 101 may be threadedly coupled to tubular 107 at second threaded coupler 105 of valve body 101 using an existing threaded end of tubular 107.

Packer element assembly 121, second end coupler 127, and floating end anchor 151 may also be positioned about tubular 107. Packer element assembly 121 may be threadedly coupled to valve body 101, and floating seal element 131 may be threadedly coupled to packer element assembly 121. Floating end anchor 151 may be positioned such that compression seal housing 153 is positioned within seal extension 135 of floating seal element 131, defined as an unset position as shown in FIG. 4.

Anchor body 163 may then be rotated relative to compression seal housing 153 until compression seal 157 is compressed into engagement with tubular 107 and compression seal housing 153. Set screws 171 may then be rotated into engagement with tubular 107, defining an anchored position as shown in FIG. 5 such that floating end anchor 151 is fixedly coupled to tubular 107. Such a configuration may also be referred to as an assembled or run-in configuration of modular downhole packer system 100.

Modular downhole packer system 100 may then be made up into a tubular string such as a casing string using first threaded coupler 103 of valve body 101 and, in some embodiments, the other existing threaded end of tubular 107. Modular downhole packer system 100 may be positioned at a desired position within a wellbore at which time modular downhole packer system 100 may be actuated. In such an actuation operation, fluid pressure from within valve body 101 may be selectively transferred to interior cavity 129 via valve assembly 109 of valve body 101, thereby causing packer element 125 to inflate radially into engagement with a wellbore or surrounding tubular. In some embodiments, as packer element 125 extends radially, second end coupler 127 may move longitudinally along tubular 107. In other embodiments, second end coupler 127 may remain fixed in position along tubular 107.

Figure 6:
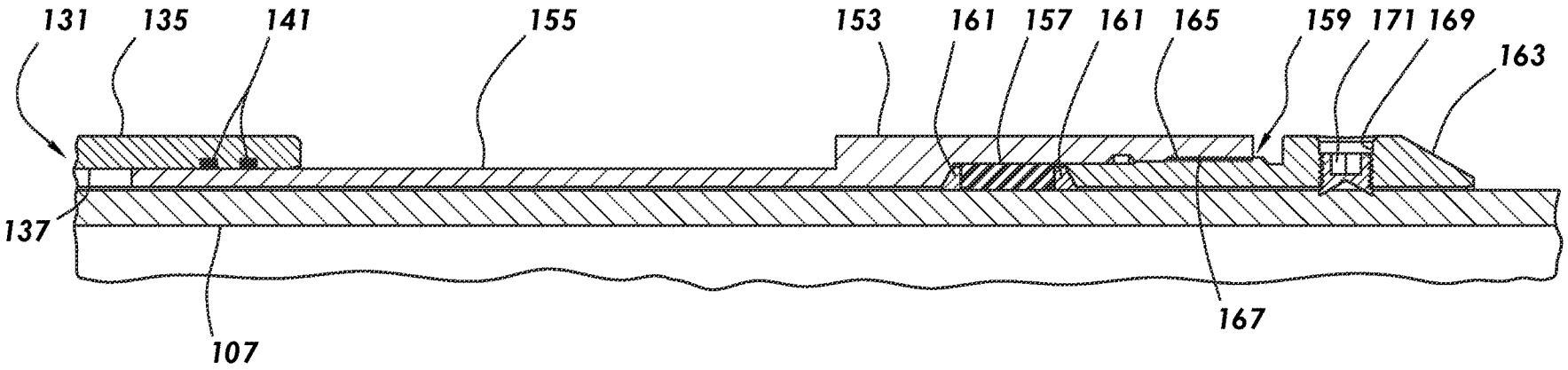
FIG. 6 depicts a partial cross section view of the modular downhole packer of FIG. 4 in a set position.

In some embodiments, as shown in FIG. 6, because second end coupler 127 is mechanically coupled to floating seal element 131, floating seal element 131 also moves longitudinally along tubular 107 such that seal extension 135 moves relative to compression seal housing 153, which is anchored in place along tubular 107 by set screws 171 as discussed above. During such movement, seals 141 maintain the fluid seal between floating seal element 131 and compression seal housing 153, thereby containing fluid pressure within interior cavity 129. Such movement continues until packer element 125 is fully engaged to the surrounding wellbore or tubular, defining a set position of modular downhole packer system 100. Valve assembly 109 may, in some embodiments, retain modular downhole packer system 100 in the set position. In other embodiments, floating seal element 131 may remain in position along tubular 107.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A modular downhole packer comprising:

a valve body, the valve body including a threaded coupler adapted to couple to a tubular and a valve assembly;

a packer element assembly, the packer element assembly including:

a first end coupler, the first end coupler mechanically coupled to the valve body;

a packer element; and a second end coupler;

a floating seal element, the floating seal element mechanically coupled to the second end coupler, the floating seal element including a seal extension; and a floating end anchor, the floating end anchor including:

a compression seal housing, the compression seal housing including an outer sealing surface positioned within the seal extension, a compression seal positioned within a seal pocket formed in the compression seal housing; and an anchor body, the anchor body threadedly coupled to the seal pocket of the compression seal housing, the anchor body abutting the compression seal.

2. The modular downhole packer of claim 1, further comprising a set screw, the set screw positioned within and threadedly engaged to a threaded hole formed radially in the anchor body.

3. The modular downhole packer of claim 1, further comprising a seal positioned between the floating seal element and the outer sealing surface of the compression seal housing.

4. The modular downhole packer of claim 1, further comprising a tubular, the tubular mechanically coupled to the valve body and positioned radially within the packer element assembly, floating seal element, and floating end anchor.

5. The modular downhole packer of claim 4, wherein the tubular is a piece of unmodified casing.

6. The modular downhole packer of claim 4, wherein the tubular is an unmodified piece of drill pipe.

7. The modular downhole packer of claim 1, wherein the first end coupler is threadedly coupled to the valve body.

8. The modular downhole packer of claim 1, wherein the floating seal element is threadedly coupled to the second end coupler.

9. A method comprising:

providing a tubular, the tubular having a threaded end;

mechanically coupling a valve body to the threaded end of the tubular;

mechanically coupling a packer element assembly to the valve body, the packer element assembly positioned about the tubular;

mechanically coupling a floating seal element to the packer element assembly;

mechanically coupling a floating end anchor to the floating seal element, the floating end anchor including a compression seal;

compressing the compression seal to the tubular; and anchoring the floating end anchor to the tubular.

10. The method of claim 9, wherein the floating end anchor comprises:

a compression seal housing having a seal pocket formed therein, the compression seal positioned within the seal pocket; and an anchor body threadedly coupled to the seal pocket, wherein compressing the compression seal to the tubular comprises:

rotating the anchor body relative to the compression seal housing such that the compression seal is compressed to the tubular.

11. The method of claim 9, wherein anchoring the floating end anchor to the tubular comprises tightening a set screw into engagement with the tubular.

12. The method of claim 9, further comprising inflating a packer element of the packer element assembly by providing fluid to a space between the packer element and the tubular via the valve body.

13. The method of claim 12, wherein the floating seal element further comprises a seal extension, wherein a compression seal housing of the floating end anchor is positioned at least partially within the seal extension, wherein inflating the packer element further comprises moving the floating seal element relative to the compression seal housing such that the compression seal housing remains within the seal extension.

14. The method of claim 13, further comprising maintaining a fluid seal between the floating seal element and the compression seal housing.

15. The method of claim 9, wherein the tubular is an unmodified piece of casing or drill pipe.

* * * * *